US005167764A

United States Patent [19]

Nielsen et al.

[11] Patent Number: 5,167,764

[45] Date of Patent: Dec. 1, 1992

[54] WET LAID BONDED FIBROUS WEB

[75] Inventors: Steven F. Nielsen; Cheryl E. Johnson, both of Charlotte, N.C.

[73] Assignee: Hoechst Celanese Corporation, Somerville, N.J.

[21] Appl. No.: 812,789

[22] Filed: Dec. 23, 1991

Related U.S. Application Data

[63] Continuation-in-part of Ser. No. 547,731, Jul. 2, 1990.

[51] Int. Cl.[5] ..... D21H 13/06; D21H 13/14; D21H 13/24; D21H 13/26; D21H 17/03

[52] U.S. Cl. ..... 162/146; 428/288; 428/297

[58] Field of Search ..... 428/288, 297; 162/146

[56] References Cited

U.S. PATENT DOCUMENTS 4,200,488 4/1980 Brandon et al. ..... 162/101

FOREIGN PATENT DOCUMENTS 279511 8/1988 European Pat. Off. .
366379 5/1990 European Pat. Off. .
2125458 3/1984 United Kingdom .

*Primary Examiner*—James C. Cannon
*Attorney, Agent, or Firm*—Philip P. McCann

[57] ABSTRACT

A bonded fibrous wet laid web containing cellulose acetate fibers, a bicomponent fiber including a polyester or polyamide fiber member and a second member having a melting point 20° C. below that of the first member and an aqueous based organic solvent which solubilizes the surface of the cellulose acetate fibers to permit bonding of said cellulose acetate fibers.

23 Claims, No Drawings

WET LAID BONDED FIBROUS WEB

This application is a continuation-in-part of U.S. Pat. application Ser. No. 07/547,731 filed Jul. 2,1990.

BACKGROUND OF THE INVENTION

1. Field of the Invention

The present invention relates to a bonded fibrous wet laid web containing cellulose acetate fibers, bicomponent fiber and a bonding agent. This bonded fibrous wet laid web not only has increased web strength, but also is found to provide greater web uniformity. In particular, the bicomponent fiber consists essentially of a first member consisting of polyester or polyamide and a second member having a lower melting point.

2. Prior Art

In the prior art processes of making wet laid webs or paper from fibers of whatever source, it is customary to suspend previously beaten fibers, or what is generally known as pulp, in an aqueous medium for delivery to a sheet-forming device, such as a Fourdrinier wire. This fiber containing aqueous dispersion is commonly referred to in the art as a furnish. One troublesome problem at this stage of making wet laid fibrous webs, is the tendency for the fibers to clump, coagulate or settle in the aqueous vehicle. This condition is generally referred to as flocculation, and greatly impedes the attainment of uniform web formation. That is, flocculation causes a nonuniform distribution of fibers in the paper product produced therefrom and manifests not only a mottled, uneven appearance, but is also defective in such important physical properties as tear, burst, and tensile strength. Another problem in making wet laid fibrous webs is a tendency of the fibers to float to the surface of the furnish.

For the manufacture of fibrous wet laid webs from conventionally used fibers such as cellulose, methods are known for attaining uniform dispersion of the fibers and reducing and even preventing the occurrence of flocculation. One of the more effective means has been to add a small amount of karaya gum to the fiber furnish. However, this has proved unsuccessful in various applications but other agents such as carboxymethyl cellulose or polyacrylamide have been used to attain the desired result of the cellulose in the furnish.

Fibrous wet laid webs may also be made from other natural or synthetic fibers in addition to the wood cellulose paper-making fibers. A water furnish of the fibers is generally made up with an associative thickener and a dispersant. The cellulose pulp is dispersed in water prior to adding the dispersant, followed by the addition of the associative thickener in an amount in the range up to 150 pounds per ton of dry fiber making up the water furnish and then the addition and dispersion of the natural and/or synthetic fibers. Finally, the dispersion of mixed fibers in a water carrier is diluted to the desired headbox consistency and dispensed onto the forming wire of a conventional paper-making machine. An antifoam agent may be added to the dispersion to prevent foaming, if necessary, and a wetting agent may be employed to assist in wetting the fibers if desired. A bonded fibrous web may be formed from the fiber furnish on a high speed conventional Fourdrinier paper making machine to produce a strong, thermally bonded fibrous wet laid web.

In prior art processes for wet lay wherein the textile staple fibers are polyester fibers, water-based binders are generally added to the process to insure adhesion between the cellulose fibers and the polyester fibers. Generally, from about 4% to about 35% binder material is employed. One of the problems encountered using a water based binder is the binder leaches out of the resultant web in such applications as filters. Addition of binders increases cost and results in environmental problems. Furthermore, latex binders have a short shelf life and require special storage conditions. Also, the latex binders may be sensitive to the condition of the diluent water employed.

It is well known to blend bicomponent fibers with natural and synthetic fibers in dry processes of making nonwoven fabrics. For example, in European Patent Application No. 0 070 164 to Fekete et al there is disclosed a low density, high absorbent thermobonded, nonwoven fabric comprising a staple length polyester/polyethylene bicomponent fiber and short length natural cellulose fibers. The U.S. Pat. No. 4,160,159 to Samejima discloses an absorbent fabric containing wood pulp combined with short-length, heat fusible fibers. Although these patents disclose the use of the combination of bicomponent fibers and cellulose fibers, the disclosure is not directed to a wet lay application. Many problems arise in attempting to incorporate a heat fusible fiber such as a bicomponent fiber into a wet lay fibrous web.

Such nonwoven textile fabrics are normally manufactured by laying down one or more fibrous layers or webs of textile length fibers by dry textile carding techniques which normally align the majority of the individual fibers more or less generally in the machine direction. The individual textile length fibers of these carded fibrous webs are then bonded by conventional bonding (heating) techniques, such as, for example by point pattern bonding, whereby a unitary, self-sustaining nonwoven textile fabric is obtained.

Such manufacturing techniques, however, are relatively slow and it has been desired that manufacturing processes having greater production rates be devised. Additionally, it is to be noted that such dry textile carding and bonding techniques are normally applicable only to fibers having a textile cardable length of at least about ½ inch and preferably longer and are not applicable to short fibers such as wood pulp fibers which have very short lengths of from about 1/6 inch down to about 1/25 inch or less.

More recently, the manufacture of nonwoven textile fabrics has been done by wet forming technique on conventional or modified paper making or similar machines. Such manufacturing techniques advantageously have much higher production rates and are also applicable to very short fibers such as wood pulp fiber. Unfortunately, difficulties are often encountered in the use of textile length fibers in such wet forming manufacturing techniques.

Problems encountered in attempting to incorporate a heat fusible fiber such as a bicomponent fiber into a wet lay process is attaining uniform dispersion of the bicomponent fiber as well as attaining a thermally bonded web with sufficient strength such that the thermally bonded web is usable. It has been found in the past that bicomponent fibers containing a sheath of high density polyethylene (HDPE) and a core of polyester are difficult to uniformly disperse in wet lay solutions. When dispersion of fibers has been attained, fibrous webs produced therefrom have been found to have lacked the desired strength.

European Patent Application 0 311 860 discloses a bicomponent fiber having a polyester or polyamide core and a sheath component consisting of a copolymer straight-chain low density polyethylene; and the bicomponent fiber can be formed into a web through the use of known methods of making nonwoven fabrics including wet laying. The copolymer polyethylene is defined as consisting of ethylene and at least one member selected from the class consisting of an unsaturated carboxylic acid, a derivative from said carboxylic acid and a carboxylic acid and a carboxylic acid anhydride. The application fails to provide any details regarding the copolymer polyethylene into a wet lay process or the resulting properties of the web produced therefrom.

There remains a need to develop a bonded wet lay fibrous web including a suitable heat fusible bicomponent filament which will not only increase the strength of the web, but also the elongation properties of the web.

SUMMARY OF THE INVENTION

The present invention is directed to a bonded fibrous wet laid web including cellulose acetate fibers, bicomponent fibers, and an aqueous based organic solvent so as to yield a bonded web not only having increased strength, but also greater web uniformity and softer than a regular paper web. In particular, the bonded fibrous wet laid web of the present invention includes cellulose acetate fibers, a bicomponent fiber comprising a first fiber member of polyester or polyamide, and a second member having a melting point 20° C. below that of the first member and an aqueous based organic solvent which solubilizes the surface of the cellulose acetate fibers to permit bonding thereof.

DESCRIPTION OF THE PREFERRED EMBODIMENTS

In the following detailed description, there is described a preferred embodiment of the invention for a composite wet-formed matt. It will be recognized that specific terms may be used in describing the preferred embodiment, these are used in the descriptive sense and are not generically, and are used for the purposes of description and not of limitation. The invention is susceptible to numerous changes and variations within the spirit and scope of the teachings herein as will be apparent to the skilled artist.

A composite wet-formed matt of the present invention is formed comprising a blend of cellulose acetate fibers, bicomponent fiber, and aqueous based organic solvent which solubilizes the surface of the cellulose acetate fibers to permit bonding of said fibers to the bicomponent fibers.

Cellulose acetate fibers are well known and commercially available. For the present invention, such fibers have a denier from about 1.5 dpf to about 8 dpf although higher dpf fibers can be used with about 1.8 dpf being preferred. The length of the fibers are from about 1/8 inch to about ½ inch fibers preferably ¼ inch fibers used.

Bicomponent fibers suitable for the present invention include a first component or a backbone polymer of polyester or polyamide or polypropylene. Polyester, polyamides and polypropylene are well known textile materials used in the manufacture of fabrics and other applications. Although polyester and polyamides have been listed, any suitable backbone polymer would include polymers having a higher melting point than the sheath material. Generally the backbone polymer has a melting point at least 20° C. higher than that of the second component.

Also included in the bicomponent fiber is a second component having a melting point 20° C. lower than that of the first member. Such components include polyester, polypropylene, etc. Preferably, the second member consists essentially of a linear low density polyethylene. Such polymers are termed "linear" because of the substantial absence of branched chains of polymerized monomer units pendant from the main polymer "backbone". It is these linear polymers to which the present invention applies. In some, there is a "linear" type ethylene polymer wherein ethylene has been copolymerized along with minor amounts of alpha, beta-ethylenically unsaturated alkenes having from 3 to 12 carbons per alkene molecule, preferably 4 to 8. The amount of the alkene comonomer is generally sufficient to cause the density of the polymer to be substantially in the same density range of LDPE, due to the alkyl side-chains on the polymer molecule, yet the polymer remains in the "linear" classification; they are conveniently referred to as "linear" low density polyethylene.

The LLDPE polymer may have a density in the range of about 0.88 g/cc to about 0.945 g/cc, preferably about 0.90 g/cc to about 0.940 g/cc. It is evident to practitioners of the relevant arts that the density will depend, in large part, on the particular alkene(s) incorporated into the polymer. The alkenes copolymerized with ethylene to make LLDPE comprises a minor amount of at least one olefinically unsaturated alkene of the form $C_3$–$C_{12}$, most preferably from $C_4$–$C_8$; 1-octene is especially preferred. The amount of said alkene may constitute about 0.5% to about 35% by weight of the copolymer, preferably about 1% to about 20%, most preferably about 1% to about 10%.

The LLDPE polymer may have a melt flow value (MFV) in the range of about 5 gm/10 min to about 200 gm/10 min as measured in accordance with ASTM D-1238(E) at 190° C. Preferably the melt flow value is in the range of about 7 gm/10 min to about 120 gm/10 min, most preferably about 10 gm/10 min to about 105 gm/10 min. Practitioners of the relevant arts are aware that the melt flow value is inversely related to the molecular weight of the polymer.

The second component of the bicomponent fiber may also include a grafted high density polyethylene (HDPE), in a blend with the LLDPE wherein the HDPE has been grafted with maleic acid or maleic anhydride, thereby providing succinic acid or succinic anhydride groups grafted along the HDPE polymer chain. The HDPE for use in the present invention is a normally solid, high molecular weight polymer prepared using a coordination-type catalyst in a process wherein ethylene is homopolymerized. The HDPE which is used in making the grafted HDPE in accordance with the present invention is characterized as having a melt flow value in the range of about 5 g/10 min to about 500 g/10 min according to ASTM D-1238(E) at 190° C. and a density in the range of about 0.94 g/cc to about 0.965 g/cc, preferably a MFV about 7 gms/10 min to about 150 gms/10 min and a density of about 0.945 g/cc to about 0.960 g/cc. The anhydride or acid groups generally comprise about 0.0001 to about 10 wt. percent, preferably about 0.01 to about 5 wt. percent of the HDPE. The ratio of grafted HDPE/ungrafted LLDPE of the present blend is in the range of about 2/98 to about 30/70, preferably about 5/95 to about 20/80.

The maleic acid and maleic anhydride compounds are known in these relevant arts as having their olefin unsaturation sites conjugated to the acid groups, in contradistinction to the fused ring and bicyclo structures of the non-conjugated unsaturated acids of e.g., U.S. Pat. No. 3,873,643 and U.S. Pat. No. 3,882,194 and the like. Fumaric acid, like maleic acid of which it is an isomer, is also conjugated. Fumaric acid, when heated rearranges and gives off water to form maleic anhydride, thus is operable in the present invention. Other alpha, beta unsaturated acids may be used.

The grafting of the succinic acid or succinic anhydride groups onto ethylene polymer may be done by methods described in the art, which involve reacting maleic acid or maleic anhydride in admixture with heated polymer, generally using a peroxide or other free-radical initiator to expedite the grafting.

Grafting may be effected in the presence of oxygen, air hydroperoxides, or other free radical initiators, or in the essential absence of these materials when the mixture of monomer and polymer is maintained under high shear in the absence of heat. A convenient method for producing the graft copolymer is the use of extrusion machinery, however, Banbury mixers, roll mills and the like may also be used for forming the graft copolymers.

Another method is to employ a twin-screw devolatilizing extruder (such as a Werner-Pfleider twin-screw extruder) wherein maleic acid (or maleic anhydride) is mixed and reacted with the LLDPE at molten temperatures, thereby producing and extruding the grafted polymer. The so-produced grafted polymer is then blended, as desired, with LLDPE to produce the blends of this invention.

Manufacture of bicomponent filaments of either the sheath/core configuration or the side-by-side configuration by the use of spinning packs and spinnerets is well known in the art. A conventional spinning process for manufacturing a fiber with a sheath/core configuration involves feeding the sheath-forming material to the spinneret orifices in a direction perpendicular to the orifices, and injecting the core-forming material into the sheath-forming material as it flows into the spinneret orifices. Reference is made to U.S. Pat. Nos. 4,406,850 and 4,251,200 which discloses bicomponent spinning assemblies and describe the production of bicomponent fibers. These patents are incorporated by reference.

Bicomponent fibers of the present invention may be either eccentric or concentric. It is understood, however, that the bicomponent fibers having side-by-side configurations or multisegmented bicomponent fibers are also considered to be within the scope of the present invention.

It has been found that such bicomponent fibers generally have a length to diameter ratio of between about 1:100 and about 1:2000. Such lengths are generally found to be about 1 mm to about 75 mm and preferably about 10 mm to 15 mm long. Diameters of the fibers are from about 0.5 dpf to about 50 dpf. Such bicomponent fibers are generally cut on conventional process machines well known in the art.

The aqueous based organic solvent has the property of being able to solubilize the surface of the cellulose acetate fibers to permit bonding of the cellulose acetate fibers together and, in some cases, with the bicomponent fibers. Suitable aqueous based organic solvents include glycerol triacetate and triethylene glycol diacetate. Concentrations of the aqueous based organic solvent range from about 5% to about 20% weight in water, preferably about 10% weight in water.

In the process for dispersing the acetate fibers, bicomponent fibers and solvents in a furnish, a whitewater system of water, thickener and dispersant is employed. The dispersant acts first to separate fibers and wet out the surface of the fibers. The thickener acts to increase the viscosity of the water carrier medium and also acts as a lubricant for the fibers. Through these actions, the thickener acts to combat flocculation of the fibers.

Various ingredients may be used as a thickener. One class of nonionic associative thickeners comprise relatively low (10,000–200,000) molecular weight ethylene oxide based urethane block copolymers and are disclosed in U.S. Pat. Nos. 4,079,028 and 4,155,892, incorporated herein by reference. These associative thickeners are particularly effective when the fiber furnish contains 10% or more staple length hydrophobic fibers. Commercial formulations of these copolymers are sold by Rohm and Haas, Philadelphia, Pa., under the trade names ACRYSOL RM-825 and ACRYSOL RHEOLOGY MODIFIER QR-708, QR-735, and QR-1001which comprise urethane block copolymers into carrier fluids. ACRYSOL RM-825 is 25% solids grade of polymer in a mixture of 25% butyl carbitol (a diethylene glycol monobutylether) and 75% water. ACRYSOL RHEOLOGY MODIFIER QR-708, a 35% solids grade in a mixture of 60% propylene glycol and 40% water can also be used.

Similar copolymers in this class, including those marketed by Union Carbide Corporation, Danbury, Conn. under the trade names SCT-200 and SCT-275 and by Hi-Tek Polymers under the trade name SCN 11909 are useful in the process of this invention. Other thickeners include modified polyacrylamides available from Nalco Chemical Company.

Another class of associative thickeners, preferred for making up fiber furnishes containing predominantly cellulose fibers, e.g. rayon fibers or a blend of wood fibers and synthetic cellulosic fibers such as rayon comprises modified nonionic cellulose ethers of the type disclosed in U.S. Pat. No. 4,228,277 incorporated herein by reference and sold under the trade name AQUALON by Hercules Inc., Wilmington, Del. AQUALON WSP M-1017, a hydroxy ethyl cellulose modified with a C-10 to C-24 side chain alkyl group and having a molecular weight in the range of 50,000 to 400,000 may be used in the whitewater system.

The dispersing agents that may be used in the present invention are synthetic, long-chain, linear molecules having an extremely high molecular weight, say on the order of at least 1 million and up to about 15 million, or 20 million, or even higher. Such dispersing agents are oxygen-containing and/or nitrogen-containing with the nitrogen present, for example, as an amine. As a result of the presence of the nitrogen, the dispersing agents have excellent hydrogen bonding properties in water. The dispersing agents are water soluble and very hydrophilic.

It is also believed that these long chain, linear, high molecular weight polymeric dispersing agents are deposited on and coat the fiber surface and make it slippery. This development of excellent slip characteristic also aids in deterring the formation of clumps, tangles and bundles. Examples of such dispersant agents are polyethylene oxide which is a nonionic long chain homopolymer and has an average molecular weight of from about 1 million to about 7 million or higher; polyacrylamide which is a long straight chain nonionic or slightly anionic homopolymer and has an average molecular weight of form about 1 million up to about 15 million or higher, acrylamide-acrylic acid copolymers which are long, straight chain anionic polyelectrolytes in neutral and alkaline solutions, but nonionic under acid conditions, and possess an average molecular weight in the range of about 2–3 million, or higher; polyamines which are long straight chain cationic polyelectrolytes and have a high molecular weight of from about 1 million to about 5 million or higher; etc. A preferred dispersant is an oxyalkylated fatty amine. The concentration of the dispersing agents in the aqueous media may be varied within relatively wide limits and may be as low as 1 ppm and up to as high as about 200 ppm. Higher concentrations up to about 600 ppm may be used but tend to become uneconomical due to the cost of the dispersing agent and may cause low wet web strength. However, if recovering means is provided whereby the aqueous medium and the dispersing agent therein is recycled and reused, then concentrations up to 1,000 ppm or even higher can result.

The fiber concentration in the fiber slurry may also be varied within relatively wide limits. Concentrations as low as about 0.01% to 6.0% by weight of the furnish are suitable. Lighter or heavier ranges may be employed for special products intended for special purposes.

It has been found that the bicomponent and acetate fibers may be equally dispersed through an aqueous medium by adding a suitable dispersing agent and thickener to the resulting fiber slurry stirring and agitation of the slurry. The dispersing agent is added to the aqueous medium first and then the bicomponent fibers followed by the thickener and the matrix fibers are subsequently added thereto. The individual bicomponent fibers and matrix fiber are dispersed in the furnish uniformly through stirring with a minimum amount of fiber flocculation and clumping.

It is believed that by so doing the fibers enter a favorable aqueous environment containing the dispersing agent which is immediately conducive to their maintaining their individuality with respect to each other whereby there is substantially no tendency to flocculate or form clumps, tangles or bundles. This, of course, is to be contrasted to the prior situation wherein when bicomponent fibers are initially placed in an unfavorable aqueous environment not containing any high molecular weight, linear polymeric, water soluble, hydrophilic dispersing agent, which environment is conducive to the loss of fiber individuality whereby the fibers flocculate and form clumps, tangles, and bundles and tend to migrate either to the top or the bottom of the furnish.

It has been found that specific types of dispersing agents are required in dispersing the bicomponent fibers of the present invention to arrive at the conditions of nonflocculation.

After the wet laid web has been formed, excess water is removed from the web by passing the web over a suction slot. The web is then saturated with the aqueous organic solvent material by a suitable applicator such as a sprayer, microfilm applicator, curtain coater, etc. Then the web is dried and bonded by passing the web through a drying machine raised to sufficient temperature to melt the second component of the bicomponent fiber. One such machine is a Honeycomb System Through-air Dryer. The heating temperature may be from 140° C. to 220° C., preferably 145° C. to 200° C. The bonded web is then cooled with the adhesive bonds forming at below the resolidification of the second component of the bicomponent fiber in addition to the action of the aqueous based organic solvent.

The invention will be described in greater detail in the following examples wherein there are disclosed various embodiments of the present invention for purposes of illustration, but not for purposes of limitation of the broader aspects of the present inventive concept.

EXPERIMENTAL PROCEDURE

Bicomponent Fibers

Bicomponent fibers were made having a substantially concentric sheath/core configuration. The core was made from a standard 0.64 IV semi-dull polyethylene terephthalate. The sheath was made from a polymer described for the specific bicomponent fiber.

Bicomponent fiber A was made having a sheath of linear low density polyethylene containing from 1–7% 1-octene wherein the polymer had a density of 0.930 g/cc, a melt flow value of 18 gm/10 min at 190° C. according to ASTM D-1236(E). Such a LLDPE is commercially available from Dow Chemical Company or Aspun Resin 6813.

Bicomponent fiber B was made having a sheath made from a blend of LLDPE and grafted HDPE wherein the blend had a density of 0.932 g/cc and a melt flow value of 16 gm/10 min at 190° C. The HDPE was grafted with maleic anhydride to contain 1 wt. % succinic anhydride groups. This sheath material is described in U.S. Pat. No. 4,684,576. The ratio of grafted HDPE/LLDPE was 10/90.

Each type of the bicomponent fibers were made by coextruding the core and sheath polymers, and drawing the resulting filaments by processes well known to those skilled in the art, to obtain the desired denier and sheath/core ratio. The bicomponent fibers were cut to have a length of about 0.5 inch.

WET LAY PROCESS

A batch fiber-water furnish was made with 500 liters of water at an ambient temperature in a mix tank equipped with an agitator rotating at 500 rpm. To the furnish was added in the following order:

a) dispersing agent Milease T which is commercially available from ICI Americas, Wilmington, Del.;
b) selected bicomponent fibers;
c) 1 liter of 1% solution modifier Nalco 061 commercially available from Nalco Chemical Company, Napierville, Ill.; and
d) cellulose acetate fibers.

Prepared in a separate tank is a 10% solution of TEGDA in water. This was pumped to a curtain coater for application.

Prepared in a separate tank with an agitator was a white water solution containing 1100 liters of water, 40 ml of Milese T, and 2 liter of 1% solution Nalco 061. The furnish and the white water solution were both pumped to the headbox of a wireformer. Pump rates were 24 l/ min of the furnish and 30 l/min of the white water to give a .044% consistency, i.e. grams of fiber to water.

Once the web was formed, it is then dried and thermally bonded thereafter to produce a bonded fibrous web. The bonded web was then tested for such properties including tensile strength, and elongation and the strength tests were done in the machine direction (MD) and the cross direction (CD). The tensile strength test is used to show the strength of a specimen when subjected to tension wherein a 1 inch wide sample by 7 inches long was pulled at 12 inch/min with a 5 inch jaw space. Elongation is the deformation in the direction of the load caused by tensile force and the reading is taken at the breaking load during the tensile test.

EXAMPLE 1

Wet laid webs were made in accordance with the four experiments shown in Table 1. Comparative experiments 1–3 depict the prior art. In particular, Comparative Experiment 1 is a web of cellulose acetate fibers with an aqueous based organic solvent triethylene glycol diacetate (TEGDA) added thereto. Comparative Experiments 2 and 3 are webs of blends of cellulose acetate fibers and bicomponent fibers. In particular, the bicomponent fibers include a core of polyester and a sheath of linear low density polyethylene blended with high density polyethylene grafted with maleic acid. Experiment 4 is a web of the present invention including cellulose acetate fibers, bicomponent fibers, same as used in Comparative Experiments 2 and 3, and TEGDA.

The web laid webs were made and bonded at temperatures shown in the Table 1. The bonded webs were tested to compare the advantages of the web laid web of the present invention.

The acetate fibers had a denier of 1.8 dpf and a length of ¼ inches. The bicomponent fibers had a denier of 3 dpf and a cut length of ½ inch. Such bicomponent fibers are commercially available as T-105 fiber type from Hoechst Celanese Corporation.

The formed webs were tested for breaking strength and elongation percentage.

TABLE 1

| | Comparative Experiment | | | Experiment |
|---|---|---|---|---|
| | 1 | 2 | 3 | 4 |
| Cellulose Acetate (CA) | x | x | x | x |
| Bicomponent Fiber (BF) | | x | x | x |
| Blend Level CA/BF | n/a | 65/35 | 70/30 | 90/10 |
| TEGDA add-on | 7.5% | — | — | 5.8% |
| Infra Red Dryer Setting | 6 | 6 | 8 | 6 |
| Honey Comb Dryer Temp, °I | 350 | 430 | 465 | 295 |
| Basis Weight (g/m$^2$) | 38.2 | 36.0 | 38.7 | 37.4 |
| Breaking Strength, lbs | 2.3 | 2.4 | 2.2 | 3.0 |
| Normalized[1] (37.0) Breaking Strength 1 lbs. | 2.2 | 2.5 | 2.1 | 3.0 |
| Elongation, % | 3.6 | 5.1 | 6.8 | 9.0 |

Superior breaking strength and elongation properties were found in the wet laid webs of the present invention.

It is apparent that there has been provided in accordance with the invention, that the thermally bonded fibrous wet laid web and a method of preparing such a web incorporating a specific bicomponent fiber, fully satisfies the objects, aims and advantages as set forth above. While the invention has been described in conjunction with specific embodiment thereof, it is evident that many alternatives, modifications and variations will be apparent to those skilled in the art in light of the foregoing description. Accordingly, it is intended to embrace all such alternatives, modifications and variations that fall within the sphere and the scope of the invention.

What is claimed is:

1. A bonded fibrous wet laid web comprising:

a. cellulose acetate fibers;

b. a bicomponent fiber comprising of first member of polyester or polyamide and a second member having a melting point 20° C. below that of the first member; and c. an aqueous based organic solvent which solubilizes the surface of the cellulose acetate fibers to permit bonding of said cellulose acetate fibers.

2. The blend of claim 1 wherein said aqueous based organic solvent is selected from the group consisting essentially of glycerol triacetate and triethylene glycol diacetate.

3. The blend of claim 1 wherein said aqueous based organic solvent is triethylene glycol diacetate.

4. The blend of claim 1 wherein said bicomponent fiber is a core/sheath fiber having a polyester core and a sheath of either polyester or polyethylene.

5. The blend of claim 4 wherein said aqueous based organic solvent is triethylene glycol diacetate.

6. The blend of claim 5 containing at least 5% bicomponent fiber.

7. A bonded fibrous wet laid web comprising:

a. cellulose acetate fiber;

b. a bicomponent fiber comprising of first member of polyester or polyamide and a second member consisting essentially of a linear low density polyethylene (LLDPE) having a density in the range of 0.88 to 0.945 g/cc; and c. an aqueous based organic solvent which solubilizes the surface of the cellulose acetate fibers to permit bonding of said cellulose acetate fibers.

8. The blend of claim 7 wherein said aqueous based organic solvent is selected from the group consisting essentially of glycerol triacetate and triethylene glycol diacetate.

9. The blend of claim 7 wherein said aqueous based organic solvent is triethylene glycol diacetate.

10. A bonded fibrous wet laid web of claim 7 wherein the first component is polyester.

11. A bonded fibrous wet laid web of claim 7 wherein the LLDPE has a density of 0.90 g/cc to about 0.940 g/cc and has a $C_4$ –$C_8$ alkene comonomer content of about 1% to about 20% by weight of the LLDPE.

12. A bonded fibrous wet laid web of claim 11 wherein the alkene comonomer comprises 1-octene.

13. A bonded fibrous wet laid web comprising:

a. cellulose acetate fiber;

b. a bicomponent fiber comprising of first member of polyester of polyamide and a second member consisting essentially of a linear low density polyethylene copolymer having a density in the range of 0.88 to 0.945 g/cc, and grafted high density polyethylene, HDPE, having initially a density in the range of 0.94 to 0.965 g/cc, which has been grafted with maleic acid or maleic anhydride, thereby providing succinic anhydride group grafted along the HDPE polymer; and c. an aqueous based organic solvent which solubilizes the surface of the cellulose acetate fibers to permit bonding of said cellulose acetate fibers.

14. The blend of claim 13 wherein said aqueous based organic solvent is selected from the group consisting essentially of glycerol triacetate and triethylene glycol diacetate.

15. The blend of claim 13 wherein said aqueous based organic solvent is triethylene glycol diacetate.

16. The bonded fibrous wet laid web of claim 13 wherein the ungrafted LLDPE has a density in the range of about 0.90 g/cc to about 0.940 g/cc and has a $C_4$–$C_8$ alkene comonomer content of about 1% to about 20% by weight of the LLDPE.

17. The bonded fiber web of claim 16 wherein the alkene comonomer comprises 1-octene.

18. The bonded fibrous wet laid web of claim 13 wherein LLDPE copolymer is one having a density in the range of about 0.88 g/cc to about 0.945 g/cc containing about 0.5% to about 35% bye weight of a $C_3$–$C_{12}$ alkene comonomer.

19. The bonded fibrous wet laid web of claim 18 wherein the ungrafted LLDPE copolymer contains about 2% to about 15% bye weight of 1-octene comonomer.

20. A process for forming a blend comprising the steps of:

a. forming a sheet consisting essentially of a blend of cellulose acetate and bicomponent fibers;

b. saturating said sheet with an aqueous based organic solvent which solubilizes the surface of the cellulose acetate fibers; and c. drying said sheet.

21. A process of claim 20 wherein said bicomponent fiber has a core/sheath arrangement wherein said core is polyester and said sheath may be polyester or polyethylene.

22. A process of claim 21 wherein said aqueous based organic solvent is selected from the group consisting essentially of glycerol triacetate and triethylene glycol diacetate.

23. A process of claim 21 wherein said aqueous based organic solvent is triethylene glycol diacetate.

* * * * *